United States Patent [19]

Beery et al.

[11] 4,431,177

[45] Feb. 14, 1984

[54] SHEET OFFSETTING AND REGISTERING APPARATUS

[75] Inventors: Jack Beery, Fairport; Werner F. Hoppner, Webster, both of N.Y.

[73] Assignee: Xerox Corporation, Stamford, Conn.

[21] Appl. No.: 182,343

[22] Filed: Aug. 29, 1980

[51] Int. Cl.[3] ..... B65H 29/40; B65H 9/10

[52] U.S. Cl. ..... 271/186; 271/187; 271/222; 271/250; 271/315; 414/54; 414/81

[58] Field of Search ..... 27/187, 186, 315, 188, 27/314, 65, 176, 83, 178, 248, 250, 221, 222; 198/403, 423; 414/54, 81

[56] References Cited

U.S. PATENT DOCUMENTS

| | | | |
|---|---|---|---|
| 671,377 | 4/1901 | Harris | 271/248 |
| 3,512,771 | 5/1970 | Dempsey et al. | 271/187 X |
| 3,719,266 | 3/1973 | Korn et al. | 271/221 UX |
| 3,847,384 | 11/1974 | Bethke | 271/187 X |
| 3,860,127 | 1/1975 | Fassman . | |
| 3,904,192 | 9/1975 | Pfeifer et al. | 271/187 X |
| 3,968,960 | 7/1976 | Fedor et al. | 271/187 |
| 3,994,487 | 11/1976 | Wicklund | 271/314 |
| 3,997,154 | 12/1976 | Mol | 271/215 |
| 4,052,053 | 10/1977 | Hasegawa et al. | 271/187 |
| 4,088,314 | 5/1978 | Phillips | 271/187 X |
| 4,120,491 | 10/1978 | Lang | 271/187 X |
| 4,188,025 | 2/1980 | Gusfafson et al. | 271/314 |

FOREIGN PATENT DOCUMENTS

| | | | |
|---|---|---|---|
| 517110 | 10/1955 | Canada | 271/248 |
| 468037 | 6/1914 | France | 198/423 |

OTHER PUBLICATIONS

Monday; J. L. "Tined Stacker Wheel", *IBM Tech. Disc. Bull.*, vol. 18, No. 7, Dec. 1975, pp. 2273–2274.

*Primary Examiner*—Bruce H. Stoner, Jr.

[57] ABSTRACT

Sheet offsetting and registering apparatus including a sheet transport to transport a sheet to a receiving station; sheet restrainer to restrain the sheet during a portion of the transport path adjacent the receiving station, an offset registration member positioned along an edge of the sheet transport adjacent the portion of the transport path having the sheet restrainer and being movable laterally with a directional component perpendicular to the direction of sheet transport, and a pivotally mounted arm to laterally move the offset registration member perpendicular to the direction of sheet transport as said sheet is transported past the registration member to gently tap the edge of the sheet and offset and register it during its path of travel. In a specific embodiment the sheet restrainer is a rotatable inverting and stacking wheel with at least one arcuate sheet retaining slot into which a sheet may be inserted such that its beam strength is increased. The wheel is incrementally rotated from the load to an unload position to strip the sheet from within the slot registering the sheet at both its leading edge and one side edge.

17 Claims, 11 Drawing Figures

SHEET OFFSETTING AND REGISTERING APPARATUS

REFERENCE TO COPENDING APPLICATION

Reference is hereby made to copending application Ser. No. 182,340 entitled Sheet Inverting and Stacking Apparatus filed concurrently herewith in the name of Jack Beery.

BACKGROUND OF THE INVENTION

This invention relates to sheet offsetting and registering apparatus and in particular to the offsetting and registering of sheets produced from automatic reproducing machines. More specifically it relates to a simple device which serves to transport copies produced from an automatic reproducing machine to an output station and collect them in an offset and registered fashion.

In the reproduction of sets of original documents in automatic reproduction machines, it is often desired to collect the finished sets such that a registered edge of successive sets are offset slightly each from the other. Typically stacking mechanism devised to accomplish this result have generally used a set stacking tray that is movable from one collecting position to another collecting position so that the deposited sheets or stack are slightly offset from each other. Frequently a reciprocating tray has been used which often is required to move so fast that the individual sets in the tray shift in position due to inertial and vibration effects. In addition, such devices are generally mechanically complicated requiring numerous rails, slides, switches and motors and the like which often times make the device somewhat unreliable.

U.S. Pat. No. 4,188,025 to Gusfafson describes an offset sheet stacking apparatus for use with a copier to selectively apply different velocity profiles to copy sheets to cause them to be delivered into offset stacks of copy sheets in a receptacle. Two rotatable rollers form a nip for propelling sheets to either of two stacking positions. At least one of the rollers is movable between two positions and in the first position imparts a first velocity profile to the sheets of the first set to move them seriatim to a first stacking position. In the second position the nip imparts a second velocity profile to the sheets of the second set to move them seriatim to a second stacking position.

In addition, in many automatic copying machines the geometry of the machine elements is such that with the paper path the copies produced have the image on the top side. Thus sequential copies enter the collecting tray with the copy or image side up. This is satisfactory if only a single copy of a single image is desired or if multiple copies of a single image is desired. In both cases, no distinction between sequential copies is required and all copies may be readily collected with the image side up. It is also satisfactory if the original documents fed to the copying machine are fed in reverse order, last or bottom sheet first and first or top sheet last. In this instance the collected set has the top sheet face up on top and the bottom sheet face up on the bottom of the set. However, in most instances of copying sets of documents, the set is face up with top sheet on the top and if copied according to normal procedures, the top sheet, number one, is copied producing a copy face up and a set so produced has sheet number one face up on the bottom and the last sheet face up on the top. It can therefore be seen that it is desired to obtain the copies in the same order as the original set so that in the set produced by the copying machine the last sheet is on the bottom of the set and the top sheet is on the top of the set, both being face up. In addition, in electronic printing it is also advantageous to be able to print from the first page to the last page in order since if you print from the last sheet to the first sheet the substance of the first to last pages must be stored in the printers memory thereby increasing the size and cost of the memory required.

This result may be accomplished in copying a set of sheets if the top sheet, number one sheet, is fed first to be copied and the copy produced which is image side up is inverted such that the image is on the bottom side. With copying of successive sheets of a set and inverting each copy the final set is collected face down with the top sheet on the bottom and the bottom sheet on the top.

A number of techniques have been used in the past for inverting sheets. Exemplary of the prior inverting devices are those that have long belt drives which drive the sheet up in a first direction and then back the sheet in an opposite direction using the original trailing edge as the leading edge.

U.S. Pat. No. 3,968,960 to Fedor et al describes a sheet inverting and stacking apparatus wherein the leading edge of a sheet is sensed at a particular location, the rotary inverter is actuated with a leading edge deflecting element engaging the leading edge to decelerate it and deflect it from its path to a stacking platform. The trailing portion of the sheet is conveyed by two belt conveyors at about its original velocity and moves past the leading edge as the leading edge is deflected around an arc by the rotary inverter so that the sheet eventually is rolled over and deposited in an inverted positon on the stacking tray or preceding sheet. With the difference in speed between the leading and trailing edges the lead edge engaging element is able to deflect the leading edge of a sheet downward as the belts urge the remaining portion of the sheet past the leading edge to cause inversion of the sheet.

With the difference in speed, the leading edge moving slower than the trailing edge, the lead edge is constantly driven against the deflecting element thereby increasing the probability of damage to the leading edge. While lead edge damage may not be a serious problem for heavyweight papers it can be a serious problem for the lighter weight papers in that the edges may be curled, bent or crushed thereby producing untidy and even misregistered sheets in a stack or set of sheets all of which lead to user disatisfaction.

Furthermore, since both the lead edge and trailing edge of the sheet are placed under stress in this type of apparatus there is the possibility of additional damage particularly for light weight paper, due to buckling, tearing and jamming.

It is also known to use continuously rotating wheels or drums which have slots, envelopes or other chambers on the periphery in which the leading edge of a sheet may be inserted as the wheel, disc or drum is rotated and the sheet is advanced into engagement with a slot opening. All these devices suffer the disadvantage that as the wheel moves, the sheet must catch up to the slot in the wheel before it is physically captured thereby increasing the probability of error in alignment of the sheet and even the possibility that the leading edge of the sheet will not be captured in the slot leading to a possible jamming of the sheet in the machine. Furthermore, with the sheet overtaking the slot the design typically allows the sheet to fully enter the slot such that the leading edge of the sheet impacts the front of the slot.

SUMMARY OF THE INVENTION

In accordance with the present invention an improved sheet offsetting and registering apparatus is provided. In particular this apparatus has an offset registration member positioned along an edge of the sheet transport path adjacent a portion of the path where the sheet is restrained, the offset registration member being movable laterally with a directional component perpendicular to the direction of sheet transport to gently tap the edge of the sheet and offset and register it during its path of travel.

In a preferred embodiment the sheet is restrained by a rotatable inverting and stacking wheel with at least one arcuate sheet retaining slot into which a sheet may be inserted such that its beam strength is increased, the wheel being incrementally rotated from the sheet load to unload position to strip the sheet from within the slot registering the leading edge of the sheet while simultaneously aligning or registering a side edge of the sheet.

Accordingly, it is an object of the present invention to provide a novel sheet offsetting and registering apparatus.

It is an additional object of the invention to provide a novel reproducing apparatus with a copy sheet offset stacker.

It is an additional object of the present invention to provide a simple, reliable, compact sheet offsetting and registering apparatus.

It is a further object of the present invention to provide a novel sheet inverting and offset apparatus.

It is a further object of the present invention to provide a sheet inverting and offset stacking apparatus which automatically inverts and stacks sheets registered along two perpendicular edges as they are delivered to it.

It is an additional object of the invention to provide a device which simultaneously inverts sheets, stacks them in a receiving tray and registers their leading edge and a side edge.

For a better understanding of the invention as well as other objects and further features thereof reference is had to the following drawings and description.

DESCRIPTION OF PREFERRED EMBODIMENT

Figure 1:
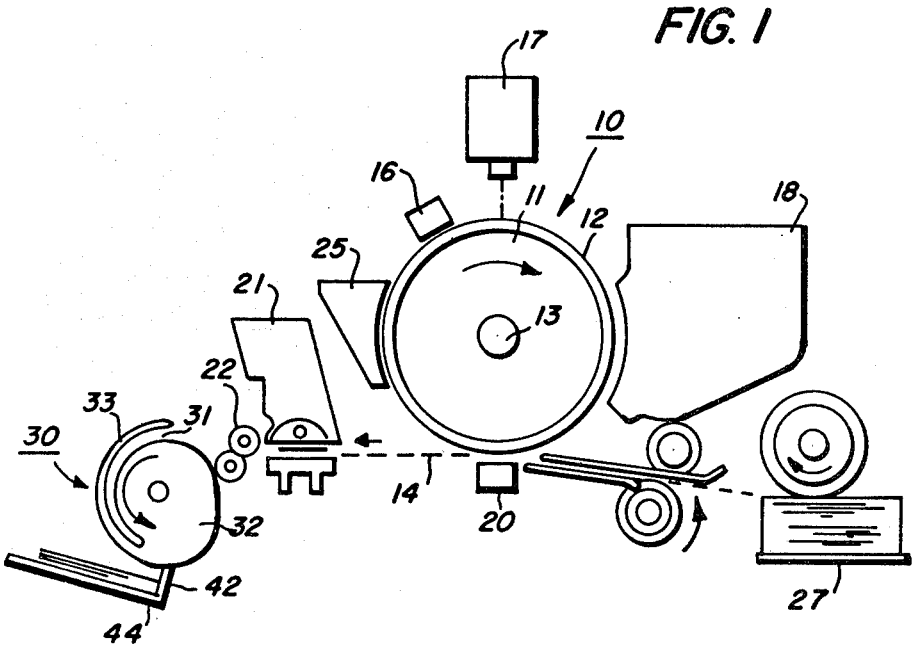
FIG. 1 is a schematic representation in cross-section of an automatic xerographic reproducing apparatus employing the sheet inverter and stacker of the present invention.

Referring now to FIG. 1, there is shown by way of example an automatic xerographic reproducing machine 10 which incorporates the sheet inverter and stacker of the present invention. The reproducing machine 10 depicted in FIG. 1 illustrates the various components utilized therein for producing copies from an original. Although the sheet inverter and stacker of the present invention is particularly well adapted for use in an automatic xerographic reproducing machine 10, it should become evident from the following description that it is equally well suited for use in a wide variety of machines where it is desired to invert and stack processed sheets. It is not necessarily limited in its application to the particular embodiment shown herein.

The reproducing machine 10 illustrated in FIG. 1 employs an image recording drum-like member 11 the outer periphery of which is coated with a suitable photoconductive material 12. The drum 11 is suitably journaled for rotation within a machine frame (not shown) by means of a shaft 13 and rotates in the direction indicated by the arrow to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material. Initially, the drum 11 moves photoconductive surface 12 through charging station 16 where an electrostatic charge is placed uniformly over the photoconductive surface 12 of the drum 11 preparatory to imaging. The charging may be provided by a corona generating device.

Thereafter, the drum 11 is rotated to exposure station 17 where the charged photoconductive surface 12 is exposed to a light image of the original input scene information, whereby the charge is selectively dissipated in the light exposed regions to record the original input scene in the form of a latent electrostatic image.

The optical system may be a conventional scanning or stationary optics or may be an electronically controlled and actuated laser source which successively strikes the photoconductive surface as a raster scan.

After exposure, drum 11 rotates the electrostatic latent image recorded on the photoconductive surface 12 to development station 18 where a conventional developer mix is applied to the photoconductive surface 12 rendering the latent image visible. Typically a magnetic brush development system utilizing a magnetizable developer mix having carrier granules and a toner colorant is used. The developer mix is continuously brought through a directional flux field to form a brush thereof. The electrostatic latent image recorded on photoconductive surface 12 is developed by bringing the brush of developer mix into contact therewith.

The developed image on the photoconductive surface 12 is then brought into contact with a sheet 14 of final support material within a transfer station 20 and the toner image is transferred from the photoconductive surface 12 to the contacting side of the final support sheet 14. The final support material may be paper, plastic, etc., as desired. After the toner image has been transferred to the sheet of final support material 14, the sheet with the image thereon is advanced to a suitable radiant fuser 21, which coalesces the transferred powdered image thereto. After the fusing process, the sheet 14 is advanced by fuser output rolls 22 to the inverter and stacker 30 of the present invention.

Although a preponderance of toner powder is transferred to the final support material 14, invariably some residual toner remains on the photoconductive surface 12 after the transfer of the toner powder image to the final support material 14. The residual toner particles remaining on the photoconductive surface 12 after the transfer operation are removed therefrom as it moves through cleaning station 25. Here the residual toner particles are first brought under the influence of a cleaning corona generating device (not shown) adapted to neutralize the electrostatic charge remaining on the toner particles. The neutralized toner particles are then mechanically cleaned from the photoconductive surface 12 by conventional means as, for example, the use of a resiliently biased knife blade.

If desired the sheets 14 of final support material processed in the automatic xerographic reproducing machine 10 can be stored in the machine within a removable paper cassette 27.

It is believed that the foregoing description is sufficient for purposes of the present application to illustrate the general operation of the automatic xerographic reproducing machine 10 which can embody the features of the present invention.

Figure 2:
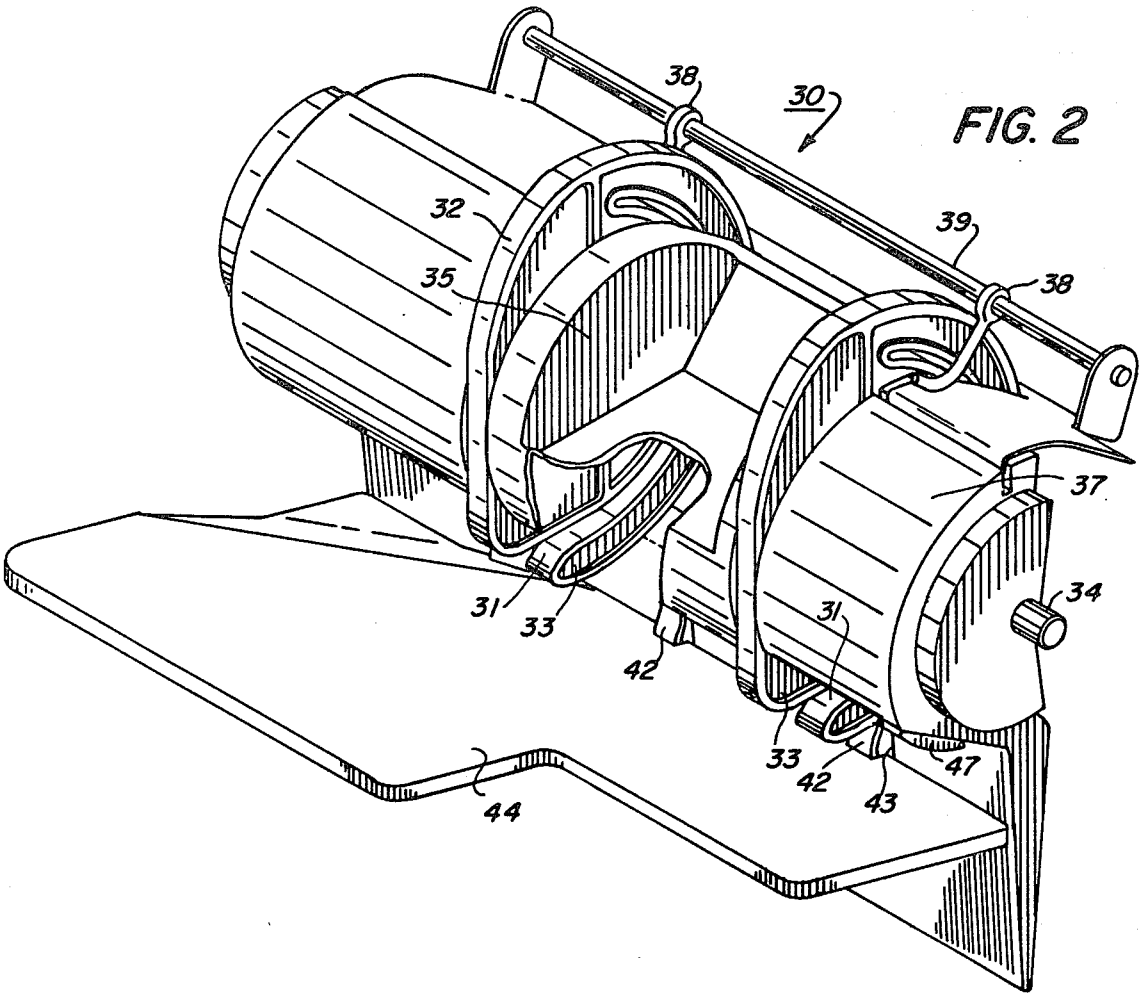
FIG. 2 is an isometric view from the right front of the sheet inverter and stacker of the present invention.

With continued reference to FIG. 1 and additional reference to FIG. 2 the inverter stacker 30 is placed at the output station of the fuser output rolls 22 such that the rolls drive a sheet to be inverted into the slot 31. When the sheet has left the output fuser rolls and is inside the slot 31 the inverter wheel 32 is rotated counterclockwise about 180° and the stripping registration members 42 strip the sheet from the slot 31 in the wheel 33 finally depositing the sheet in tray 44 as the wheel continues to turn.

The inverter stacker 30 comprises an interior stationary drum or hub 37 which is generally circular in configuration from the inverter wheel load position to the unload position and rounded from the sheet unload to load position. The drum 37 has a hand indent 35 in the center to facilitate manual sheet removal should the need arise if jamming of a sheet occurs. A drive shaft 34 which is driven by means not shown drives two parallel arcuate arms 33 having parallel arcuate sheet retaining slots 31 therein so that a sheet may be transported in the slots from the sheet load to the sheet unload position. Sheet guides 38 mounted on shaft 39 assist in guiding a sheet into the retaining slots 31. After insertion of the sheet as the wheels are turned and the sheet moves from the load to the unload position, the trailing portion is maintained in position against the hub 37 by sheet guides 38. When the parallel arms turn counterclockwise the sheet is retained within the slots 31. However as the arms turn through the bottom portion of the arc they pass through apertures 43 in the stationary hub 37. When the lead edge of the sheet in the slot 31 approaches the unloading position the vertical stripping registration members 42 which are interposed between and on the outsides of the arms 33 strip the sheet from the slot into the sheet collecting tray 44. As the sheet is stripped from the slot 31 registration of the leading edge of the sheet is achieved as the sheets abut against the members 42. Registration is also maintained as the arm rotates completely out of position, each sheet having its leading edge registered in the tray. This is readily facilitated because as each sheet is stripped from the slot 31 it drops into the tray free of friction between adjacent sheets because the velocity of the sheet being stripped is zero relative to the previous sheet in the tray.

Figure 3A:
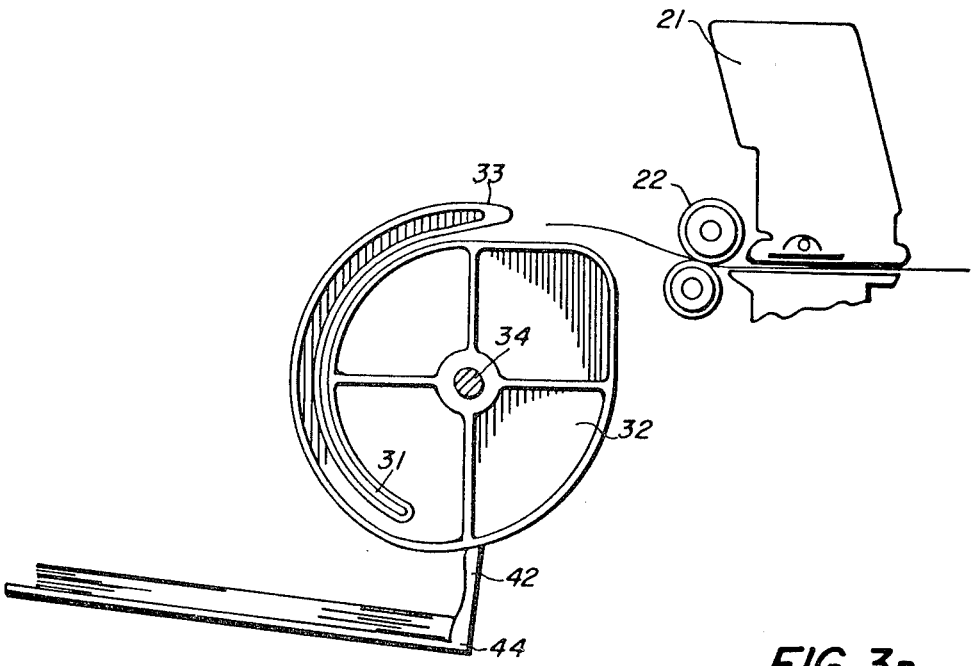
FIGS. 3A, 3B and 3C are enlarged schematic representations in cross-section showing the location of a sheet in the inverter stacker at three separate points in the operational cycle.
Figure 3B:
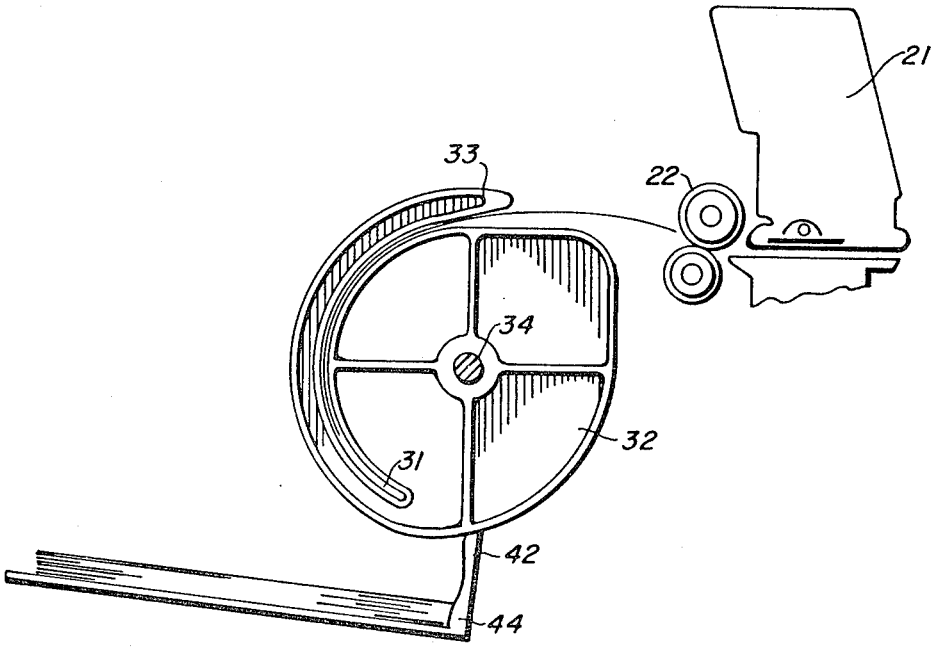
Figure 3C:
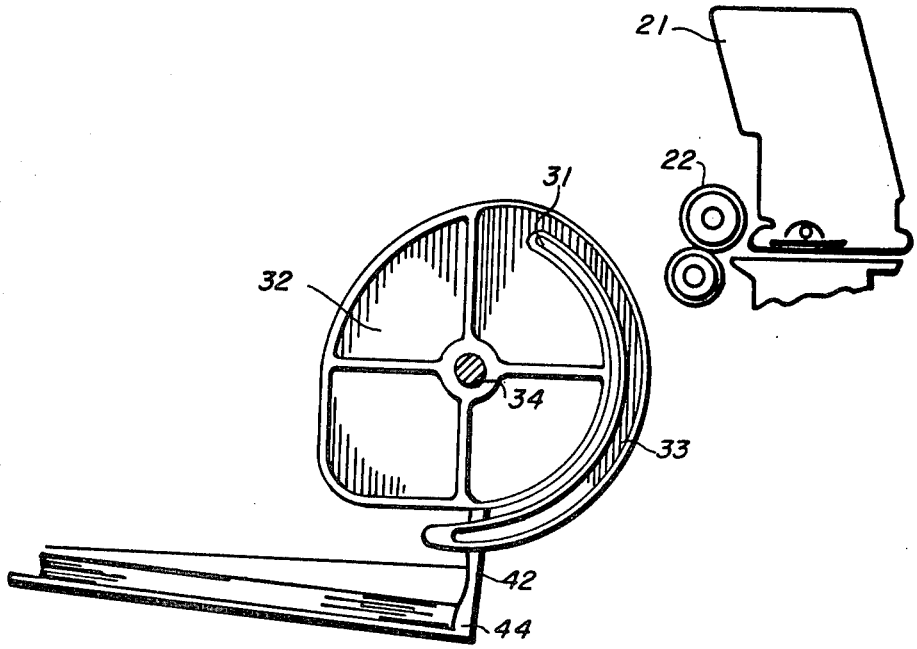

With additional reference to FIGS. 3A, 3B, and 3C the operation will be further described. The inverter wheel 32 is driven from the unload or shut down position as a sensor (not shown) senses a sheet exiting the output fuser rolls 22. The inverter wheel reaches the load position with the slots 31 in arms 33 ready to accept the lead edge of the sheet being driven by the fuser output rolls 22. The fuser output rolls 22 continue to drive the sheet into the slot 31 until the sheet is clear of the rolls. The distance between the fuser output rolls and the end of the slot 31 is longer than the length of any sheet likely to be fed to the inverter. In this way the lead edge of the sheet does not come in contact with the slot end and is not driven against any hard surface thereby minimizing the opportunity for damaging the leading edge of the sheet. The inverter assembly is placed sufficiently close to the fuser output rolls and the slot 31 is sufficiently long that a substantial portion of the sheet at least is inserted in the slots 31. This portion should be sufficient to maintain physical control over the sheet when it travels from the load to the unload position. In ensuring control over the sheet preferably a majority of the sheet is inserted in the slots. This permits a greater percentage of the sheet to be touched by the sides of the slot and by friction with the slot surfaces transported while in the slots to the unload position. During sheet insertion the inverter wheel 30 is stationary to facilitate predictable sheet insertion on each cycle.

Once the trailing edge of the sheet has cleared the output fuser rolls 22 the inverter wheel 32 is rotated counterclockwise to the unload position and carries with it the sheet to be inverted. At the output station the lead edge of the sheet in the slots comes into contact with the stripping registration members 42 which inhibit further travel of the sheet. Thus as the movement of the sheet is stripped the inverter wheel continues to rotate until the arms 33 have cleared the sheet stripping zone. As each sheet is sheared off the arcuate slots one at a time by the stripping members 42 and when the trailing edge of the arms 33 has cleared the leading edge of the sheet the sheet floats down into the sheet stacking tray. When the trailing edges of the arms of the inverter wheel have cleared the stripping registration members, it stops at the unload position to wait for the next inverting cycle. With the inverter arms at the bottom of the cycle in the unload position the inverter is readily cleared of any jamming of sheets.

With specific references to FIGS. 3A, 3B and 3C, FIG. 3A shows the leading edge of the sheet entering the slot 31 while being driven by the fuser output rolls 22. FIG. 3B depicts the sheet positioned in the slot after sheet insertion when the sheet has exited the output fuser rolls. During this operation the inverter has remained stationary while the sheet has gently slid down the slot without the leading edge being abutted against the slot end. As may also be observed, the majority of the sheet is captured within the slot 31. FIG. 3C shows the trailing edge of the arm 33 clear of the sheet stripping and registration members 42 as the sheet is about to gently fall while being registered against the stripping and registration member with the tray 44.

Figure 5:
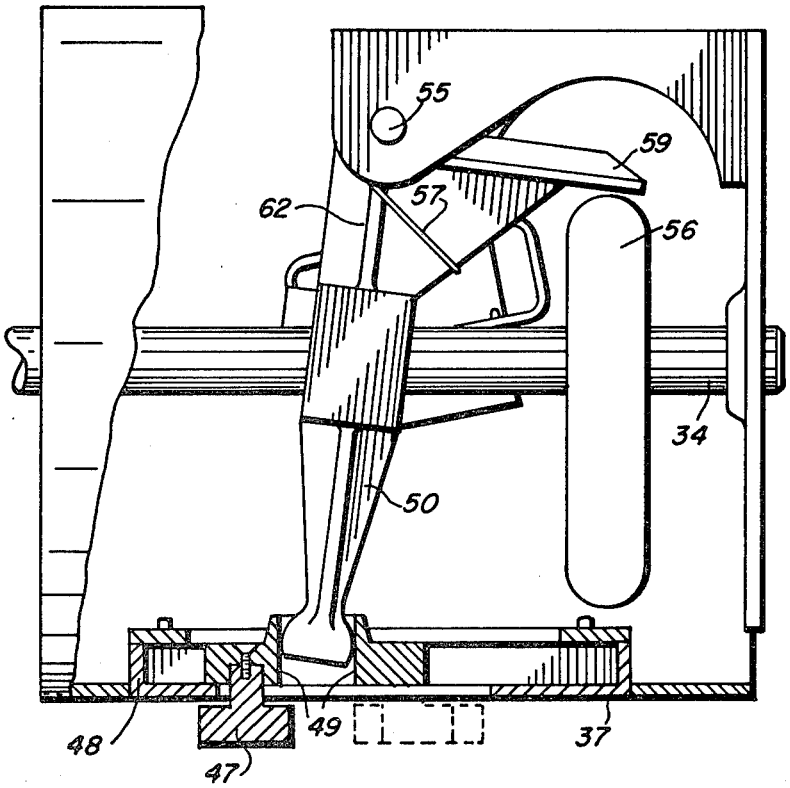
FIG. 5 is a view looking down through plane AA of FIG. 4 showing the offsetting mechanism in its fully extended position with the latch disengaged providing maximum side edge offsetting. The dotted line for the offset registration member represents the position with the latch engaged.
Figure 6:
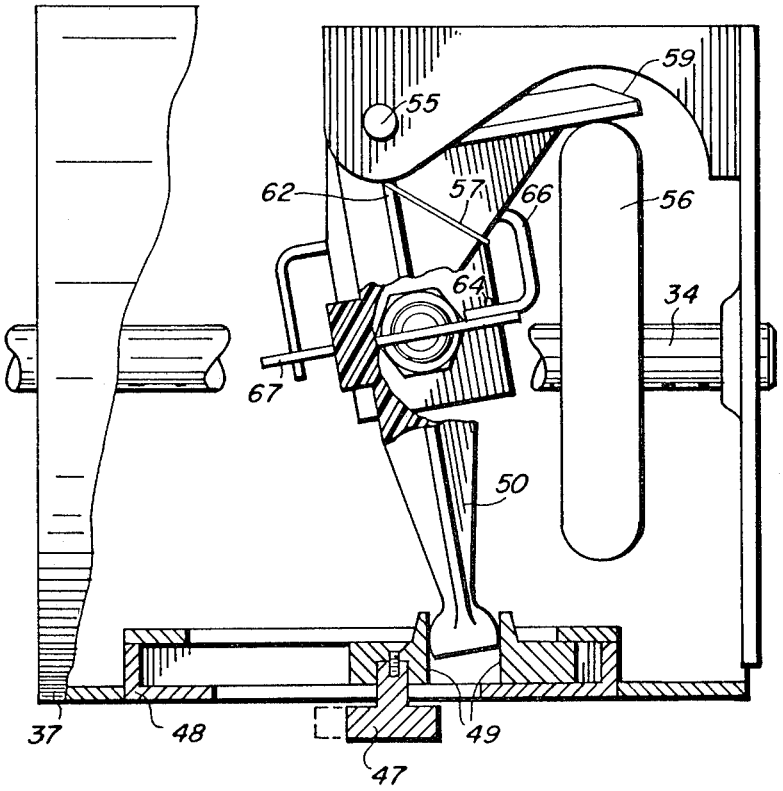
FIG. 6 is a view looking down through plane AA of FIG. 4 showing the offsetting mechanism in its fully retracted or home position with part of the cam follower assembly broken away to show details of construction.

Referring again to FIG. 2 the offset tapper head 47 may be seen on the surface of the stationary hub or drum 37 near the bottom to provide an offsetting action to the paper. For a further description of this mechanism attention is directed to FIGS. 4, 5, 6 and 7. The offset tapper head 47 is mounted in a slidable support bracket 49 which rides in a frame 48 fixedly mounted in the stationary hub or drum 37. FIG. 5 depicts the position of the bracket fully extended (latch open) for maximum sheet tapping action or offset. The dotted line position in FIG. 5 represents the position of tapping head 47 when in its first offsetting position (latch closed). FIG. 6 shows the tapping head 47 in its fully retracted or home position. The movement of tapping head slider assembly from position to position is controlled by the pivotal arm 50 which is positioned to ride through slot 51 on drive shaft 34. The arm 50 is pivoted at pivot point 55 which is fixedly mounted to the stationary hub or drum 37.

Figure 7:
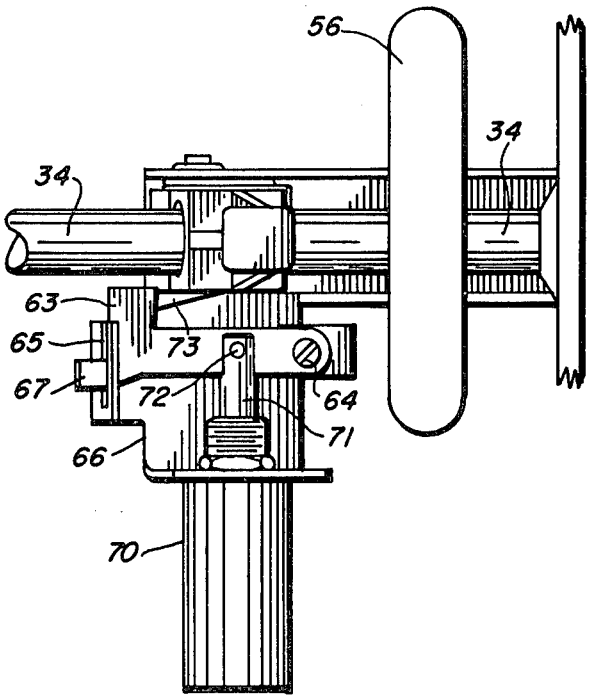
FIG. 7 is a view looking up through the plane BB of FIG. 4 showing the latch mechanism in the first offsetting position.

The position of the pivotal arm 50 is controlled by the joint action of a cam 56, a wrapped spring 57 and a latching mechanism 58 which may be more completely seen with reference to FIG. 7. The cam 56 is fixedly mounted to drive shaft 34 so that the operation of the offsetting head may be perfectly and continuously synchronized with the inverter. As the cam 56 rotates the position of the cam follower 59 is altered thereby altering the location of the tapper head 47. With the cam lobe at its maximum extension at the top as may be seen in FIG. 6 the cam follower 59 is raised up and the tapper head moved to the extreme right to its base or home position. As the cam 56 continues to rotate and the maximum dimension of the cam lobe is reduced, the spring 57 wrapped around pivot 55 contacts spring stop 62 and urges the pivotal arm 50 to the left thereby moving the tapping head 47 to its maximum offset extension as may be seen in FIG. 5. Thus the cam and the spring jointly provide two positions for the tapping head, the home inoperative position and the maximum tapping or offset position. Since the cam follower will always control the position depending on its configuration over the urging action of the spring the length of the cycle in the maximum position may be readily controlled by the shape of the cam face since the cam is fixed to the inverter drive shaft.

Figure 4:
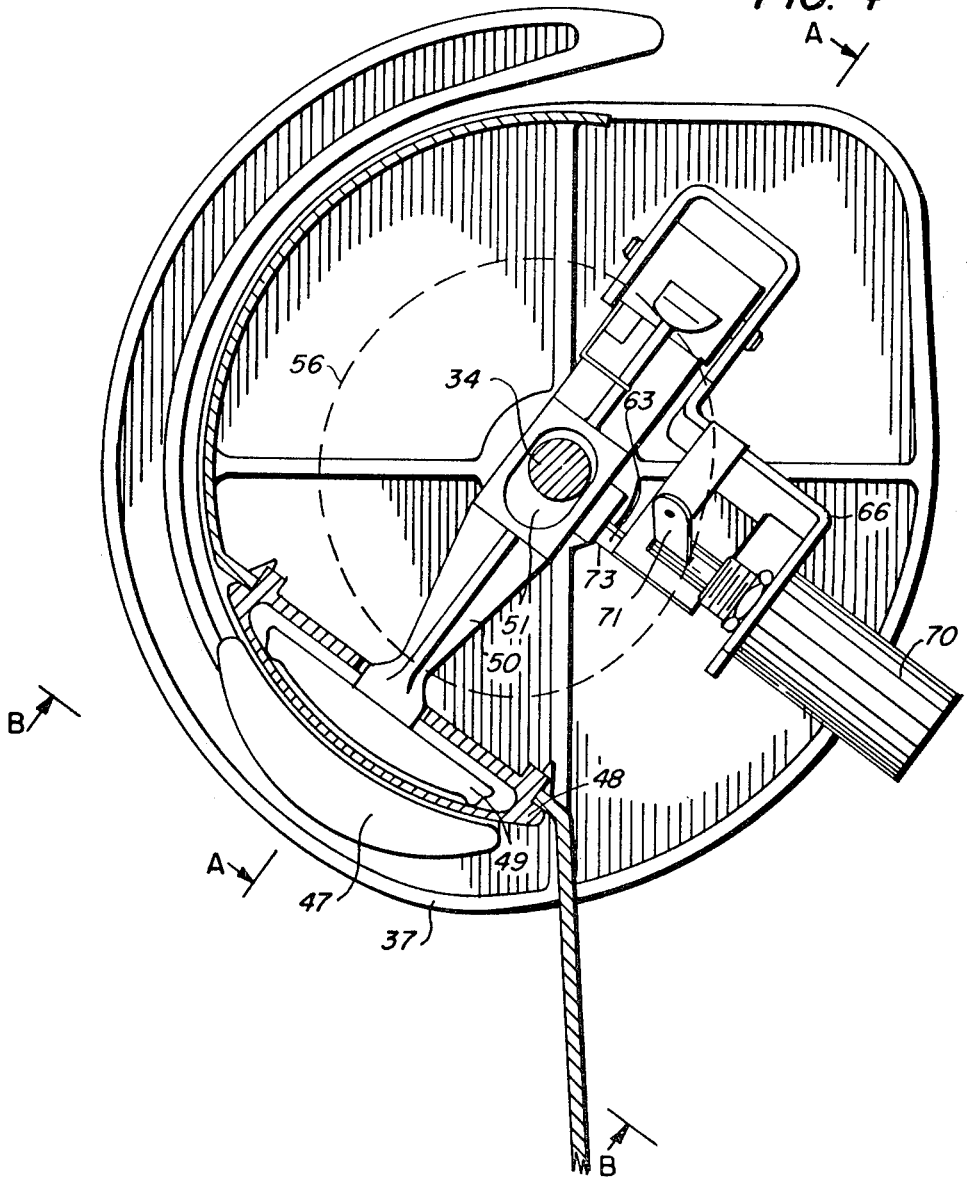
FIG. 4 is an end view of the inverter stacker showing the offsetting mechanism with the latch engaged.

To provide a second stop position in addition to the home and maximum positions a retractable latch mechanism which may be more completely understood with reference to FIGS. 4, 6 and 7 is provided. This latch mechanism includes a pivotal latch arm 63 which pivots about point 64 with one end 67 which rides in slot 65 in latch frame 66 to maintain the latch at a constant level. The latch frame 66 is fixedly mounted to the stationary hub or drum 37 and also provides support for the solenoid 70 which through solenoid plunger 71 and pin 72 moves the latch arm 63 into engagement and disengagement with the latch stop 73 on pivotal arm 50. As may be more readily seen with reference to FIG. 4 when the solenoid 70 is energized it withdraws the latch arm 63 from engagement with the latch stop 73 on the pivotal arm enabling the arm to move axially along the drive shaft to its maximum position. However when the solenoid 70 is deenergized the latch end 67 contacts the latch stop 73 of the pivotal arm thereby inhibiting further travel of the pivotal arm along the drive shaft 34 and providing a three position offsetting arrangement wherein two positions are automatically synchronized to the action of the sheet transport inverter wheel and the third position controlled by the solenoid actuated latch assembly which may be readily controlled by simple machine logic.

Having described the arrangement of the offset and stacking device reference is now briefly made to the operation of the device in which successive sheets of paper may be offset and registered in the stacking tray. In the home position the cam has the largest profile at the top and the sheet tapping head is withdrawn to the inoperative home position as seen in FIG. 6.

Figure 9:
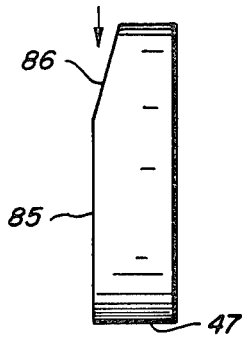
FIG. 9 is a top view showing the operative profile of the tapping head.

In the first stacking or registering position the latch is engaged, the solenoid is deenergized and the pivot arm is capable of moving from the home position to the position where it engages the latch. The rate of this motion and thereby the specific offsetting action of the tapping head is controlled by the cam profile which may be of a suitable type. Typically the cam profile may be cycloidal since this has the advantage of being smooth running and is capable of use at high speed. Following the cam profile the tapping head gently taps a sheet in the inverter just as it is about to be stripped from the slots and registered against the fixed register stops. With the movement of the tapping head controlled by the profile of the cam which is fixed to the drive shaft of the inverter, the cyclic tapping of each sheet by the tapping head and removal of the head to the home position may be readily controlled. Thus the tapping head moves from the base position into tapping engagement with each sheet as it approaches the stripper in the inverter and provides the offset registration. Since the sheet is curved in one direction, its beam strength may be significantly enhanced and it is thereby more readily moved sideway to a different location. It should be noted that while the tapping actions of the tapping head should be sufficient to gently move the sheet laterally it should not damage the edge of the paper. In addition since the friction between the sheet and the slots control the extent of paper movement laterally the friction should not be so great as to buckle the paper against the frictional restraining force. To assist in this type of action reference is had to FIG. 9 which shows the operative profile of the tapping head including a first flat portion for tapping and a second inclined portion for gently directing the edge of a sheet being fed, depicted by the arrow, toward the tapping portion. This configuration provides a chute guide to urge the sheet in a direction perpendicular to the sheet transport direction. With this device the variability in the position of the sheet in the inverter is minimized and the misregistration due to original misregistration in sheet supply is also minimized.

Figure 8:
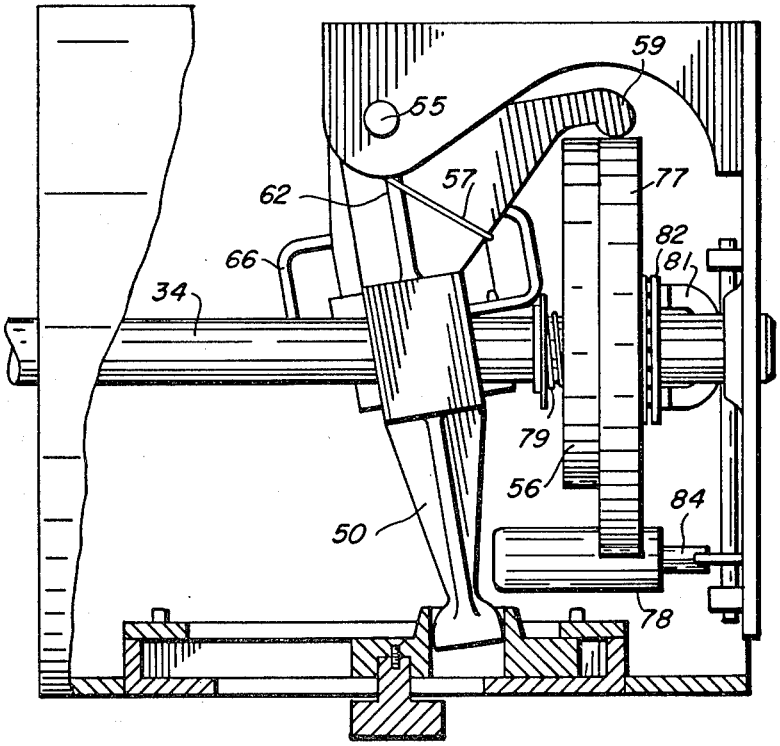
FIG. 8 is a view similar to FIG. 5 showing an alternative embodiment of the cam activated offsetting mechanism.

In the second position the solenoid is energized and the latch is disengaged permitting the sheet tapping head to give a full offset tap to the sheet in the inverter as it is about to be stripped from the slots. The tapping and registration mechanism is the same in this position as it is in the first tapping position. The above provides a home position and two registration positions for the sheets being processed. It thus provides stacking for two different displaced registration edges. If a third edge is desired reference is had to the alternative embodiment of FIG. 8 which differs from the above described device in the use of a second cam 77 which is urged into contact with cam follower 59 by solenoid 78 when it is activated. In normal operation spring 79 urges the main cam 56 into engagement with the cam follower 59. However when the solenoid 78 is activated it pulls linkage 84 to the left which in turn pulls the cam fork 81 and the roller bearing 82 to the left so that cam 77 engages cam follower 59. With this arrangement an additional sheet offsetting may be provided.

The above described stacking and registering device has the advantage of simplicity of design and operation. It has the advantage of gently tapping the edge of sheets while they are constrained so that a greater degree of control is maintained over the sheet. In the preferred embodiment and particularly for light weight sheets, the sheets are physically constrained so that their beam strength is increased thereby facilitating displacement of the sheet in a direction perpendicular to the sheet transport. By bending the sheet the natural beam strength is increased and it may be more readily moved laterally. This may be significant for lighter weight sheets so that they may be displaced without wrinkling or folding over but of course with heavier and thicker sheets it is less important. For example if light weight sheets were physically unconstrained in such a way as to lessen the beam strength when tapped by the tapping head they could do everything from buckle to float on air in a totally unpredictable manner. The apparatus has the further advantage of simultaneously registering a sheet along two perpendicular edges and it also has the advantage of providing an inverter stacker which collects collated sets of sheet, each set being offset from the other.

While this invention has been described with reference to the specific embodiment described, it will be apparent to those skilled in the art that many alternatives, modifications and variations may be made by those skilled in the art. For example while the invention has been described with reference to sheets being confined around an arcuate path, the principle will work equally well with flat sheets as long as they are restrained to permitting the tapping head to offset the successive sheets in a predictable manner. In addition while the invention has been described with reference to an offset registration member moving perpendicular to the sheet transport direction, it is only necessary that the offset registration member provide a directional component perpendicular to the sheet transport direction. Thus the offset registration member may be moved at an angle to the sheet transport direction. It is intended to embrace all such alternatives and modifications as may fall within the spirit and scope of the appended claims.

We claim:

1. A sheet offsetting and registration apparatus comprising;

means to transport a sheet along a path from a sheet supply to a sheet receiving station;

means to restrain said sheet during a portion of the transport path adjacent the receiving station, an offset registration member positioned along an edge of the sheet transport adjacent the portion of the transport path having said sheet restraining means, said offset registration member being movable laterally with a directional component perpendicular to the direction of sheet transport, means to laterally move said offset registration member with a directional component perpendicular to the direction of sheet transport as said sheet is transported past said member whereby the side edge of said sheet is gently tapped, offset and registered during its path of travel to a first position, said means to laterally move said offset registration member comprising means to urge said member forward perpendicular to the direction of sheet transport with a sheet edge tapping action to a first offset register position and means to retract said member to a standby position, said means to urge and said means to retract comprising a pivotally mounted arm which engages said offset registration member at one end and has a cam follower at the other end, said arm being sping biased to urge said offset register member in a direction perpendicular to the direction of sheet transport, and a cam in operative relationship with said cam follower to urge said offset registration member toward the standby position, said sheet offsetting and registration apparatus further including means to provide an intermediate sheet offset and registration position between said first offset register position and said standby position, said means including a stop portion fixed to said pivotal arm and a retractable latch which in latching position engages said stop portion inhibiting movement of said pivotal arm to said first offset position and means to retract said latch.

2. The sheet offsetting and registration apparatus of claim 1 wherein said means to restrain said sheet includes means to increase the beam strength of a sheet.

3. The sheet offsetting and registration apparatus of claim 1 wherein said offset registration member comprises a movable finger having a first sheet tapping portion parallel to the direction of sheet transport and a second sheet entry portion upstream of and connected to said first portion inclined to the perpendicular in such a way that it provides a chute guide to urge a sheet in a direction perpendicular to the direction of sheet transport.

4. The sheet offsetting and registration apparatus of claim 5 including a second cam surface in operative association with said cam follower to provide an additional offsetting and registration position.

5. The sheet offsetting and registration apparatus of claim 1 wherein said sheet transport and restraining means comprise a sheet inverter wheel including at least one arcuate sheet retaining slot into which a sheet may be inserted.

6. The sheet offsetting and registration apparatus of claim 5 wherein said slot is sufficiently long in arcuate length to accommodate at least a substantial portion of the length of a sheet to be inverted without the leading edge of the sheet contacting the end of the slot.

7. The sheet offsetting and registration apparatus of claim 6 including means to incrementally rotate said sheet inverter wheel from a sheet load position to a sheet unload position, sheet drive means to drive a sheet in a forward direction into said slot when said inverter wheel is in the load position, the distance between the sheet drive means and the end of the slot in the inverter wheel when in the load position being greater than the length of a sheet to be fed whereby the leading edge of the sheet does not contact the end of said slot, and a sheet stripper registration member at the unload position to strip a sheet from within the slot and register its leading edge whereby two edge registration is provided.

8. The sheet offsetting and registration apparatus of claim 7 wherein said inverter comprises a fixed member having a generally cylindrical surface from said load position to said unload position and two larger parallel rotatable arcuate arms having parallel arcuate slots therein for transporting sheets from said load to said unload position whereby said sheets may be held in said slots above the fixed cylindrical surface.

9. The sheet offsetting and registration apparatus of claim 8 wherein said means to incrementally rotate said sheet inverter wheel brings said wheel to a stop at both the load and unload positions.

10. The sheet offsetting and registration apparatus of claim 8 wherein said means to incrementally rotate said sheet inverter wheel is independent of said sheet drive means.

11. The sheet offsetting and registration apparatus of claim 8 wherein said inverter wheel is in the load position when the slot opening is at the top and is in the unload position when the slot opening is at the bottom of the path through which the wheel is rotated.

12. The sheet offsetting and registration apparatus of claim 8 wherein said sheet stripper registration member comprises fixed vertical stop members interposed between the path of said rotatable arcuate arms.

13. The sheet offsetting and registration apparatus of claim 8 wherein said cylindrical surface has apertures in the path from the unload to load position through which the arcuate arms may rotate.

14. The sheet offsetting and registration apparatus of claim 8 including a stacking tray adjacent the unload position for stacking sheets as they are stripped from the slots in the inverter wheel.

15. The sheet offsetting and registration apparatus of claim 8 wherein said sheet drive means comprises a pair of driven pinch rolls at the output end of a fuser in an automatic copying machine.

16. The sheet offsetting and registration apparatus of claim 8 wherein said slot has an arcuate length longer than the size of a sheet to be inverted and stacked.

17. The sheet offsetting and registration apparatus of claim 7 wherein said sheet unload position is substantially opposite said sheet load position on said inverter wheel.

* * * * *